US008713744B2

(12) United States Patent
Best et al.

(10) Patent No.: US 8,713,744 B2
(45) Date of Patent: May 6, 2014

(54) APPLICATOR WITH FLEXIBLE PAD AND HANDLE

(75) Inventors: Jim Joseph Best, Hewitt, NJ (US); Marco Carroll Perry, Brooklyn, NY (US); Mark David Prommel, Brooklyn, NY (US); Kevin Min O'Leary, Brooklyn, NY (US); William Lauchlin Gulledge, Jr., Leawood, KS (US); William Daniel Richardson, Greenwood, MO (US); Chad Edward Brott, Greenwood, MO (US); B. Deré Newman, Lone Jack, MO (US); Melodie Lea Wendleton, Lee's Summit, MO (US); Benjamin A. Shobert, Indianapolis, IN (US); Richard S. Dale, Honeoye Falls, NY (US); Todd Brunner, Brooklyn, NY (US)

(73) Assignee: Specialty Products of Greenwood, Missouri, Inc., Greenwood, MO (US)

( * ) Notice: Subject to any disclaimer, the term of this patent is extended or adjusted under 35 U.S.C. 154(b) by 37 days.

(21) Appl. No.: 13/085,385

(22) Filed: Apr. 12, 2011

(65) Prior Publication Data

US 2011/0247162 A1 Oct. 13, 2011

Related U.S. Application Data

(60) Provisional application No. 61/323,804, filed on Apr. 13, 2010.

(51) Int. Cl.
*B08B 1/00* (2006.01)

(52) U.S. Cl.
USPC ..... 15/210.1; 15/209.1

(58) Field of Classification Search
USPC ..... 15/209.1, 210.1
IPC ..... B08B 1/00
See application file for complete search history.

(56) References Cited

U.S. PATENT DOCUMENTS

| | | | | |
|---|---|---|---|---|
| 5,267,369 | A * | 12/1993 | O'Neil et al. | 15/210.1 |
| 5,293,662 | A | 3/1994 | Newman, Sr. et al. | |
| 5,432,972 | A | 7/1995 | Polzin et al. | |
| 5,822,823 | A | 10/1998 | Polzin et al. | |
| 6,272,715 | B1 | 8/2001 | Polzin et al. | |
| 2002/0112664 | A1 | 8/2002 | Johnson | |
| 2004/0158949 | A1 | 8/2004 | Booth et al. | |
| 2006/0179595 | A1 | 8/2006 | Serio et al. | |
| 2008/0189892 | A1 | 8/2008 | Lutgen et al. | |

FOREIGN PATENT DOCUMENTS

EP 2138240 A1 11/1938

OTHER PUBLICATIONS

PCT Search Report and Written Opinion from PCT Application No. PCT/US2011/032304 entitled Applicator With Flexible Pad and Handle (Dated Nov. 30, 2011).

* cited by examiner

*Primary Examiner* — Monica Carter
*Assistant Examiner* — Stephanie Berry
(74) *Attorney, Agent, or Firm* — Hovey Williams LLP

(57) ABSTRACT

A liquid applicator includes a frame and a flexible applicator pad. The frame includes an elongated handle that presents opposite handle margins and extends in a longitudinal direction between the margins. The flexible applicator pad presents opposite applicator pad ends. The handle margins are coupled relative to the flexible applicator pad adjacent corresponding applicator pad ends. The handle presents an intermediate region that is flexible and spaced from the pad, with the liquid applicator thereby being shiftable into and out of a relaxed applicator condition.

10 Claims, 6 Drawing Sheets

APPLICATOR WITH FLEXIBLE PAD AND HANDLE

RELATED APPLICATION

This application claims the benefit of U.S. Provisional Application Ser. No. 61/323,804, filed Apr. 13, 2010, entitled APPLICATOR WITH FLEXIBLE PAD AND HANDLE, which is hereby incorporated in its entirety by reference herein.

BACKGROUND

1. Field

The present invention relates generally to devices for material application. More specifically, embodiments of the present invention concern a liquid applicator with a flexible handle and a flexible applicator pad.

2. Discussion of Prior Art

Various forms of brushes have been employed for manual application of liquid coatings (e.g., paints, stains, and varnishes) to surfaces. For instance, handheld bristle brushes and foam brushes are commonly used to apply such coatings and come in numerous shapes and sizes. It is also known in the art to have a flexible brush with a flexible foam pad mounted to a frame that moves to flex the pad.

Conventional brushes for coating application suffer from certain undesirable limitations. Bristle brushes and foam brushes, while both adaptable to manually apply coatings to various surfaces, are not well suited for applying liquids uniformly in a single brush stroke, particularly when the single brush stroke is intended to cover a surface that undulates across the stroke width. Known flexible brushes also fail to include a frame and pad construction that enables the frame to be held in numerous flexed conditions, with the frame permitting flexing pad movement along the length of the pad in each condition.

SUMMARY

The following brief summary is provided to indicate the nature of the subject matter disclosed herein. While certain aspects of the present invention are described below, the summary is not intended to limit the scope of the present invention.

Embodiments of the present invention provide a liquid applicator that does not suffer from the problems and limitations of the prior art applicators set forth above.

A first aspect of the present invention concerns a liquid applicator that broadly includes a frame and a flexible applicator pad. The frame includes an elongated handle that presents opposite handle margins and extends in a longitudinal direction between the margins. The frame further includes a pair of connectors that are each hingedly coupled to respective ones of the handle margins. The flexible applicator pad presents opposite applicator pad ends. The connectors are coupled to the flexible applicator pad adjacent corresponding applicator pad ends. The handle presents a region intermediate the handle margins that is flexible and spaced from the applicator pad to permit relative shifting of the handle margins, with the frame and flexible applicator pad thereby being shiftable into and out of a relaxed applicator condition as the handle margins are moved away from and toward each other.

A second aspect of the present invention concerns a liquid applicator that broadly includes a frame and a flexible applicator pad. The frame includes an elongated handle that presents opposite handle margins and extends in a longitudinal direction between the margins. The flexible applicator pad presents opposite applicator pad ends. The handle margins are coupled relative to the flexible applicator pad adjacent corresponding applicator pad ends. The handle presents a handle region intermediate the ends that is flexible and spaced from the pad, with the handle and flexible applicator pad thereby being shiftable into and out of a relaxed applicator condition. The intermediate region is flexed in the relaxed applicator condition so that the handle margins urge the applicator pad ends in opposite directions to hold the applicator pad under tension.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
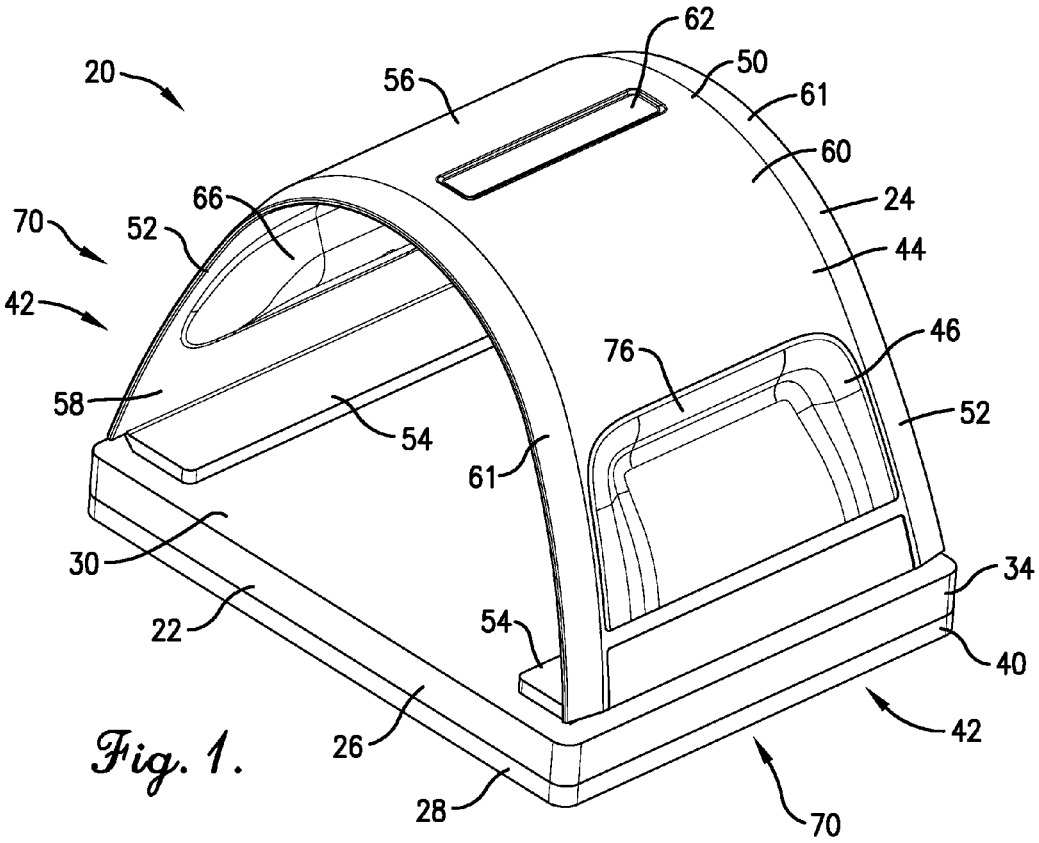
FIG. 1 is a perspective of a material applicator constructed in accordance with a preferred embodiment of the present invention.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 6:
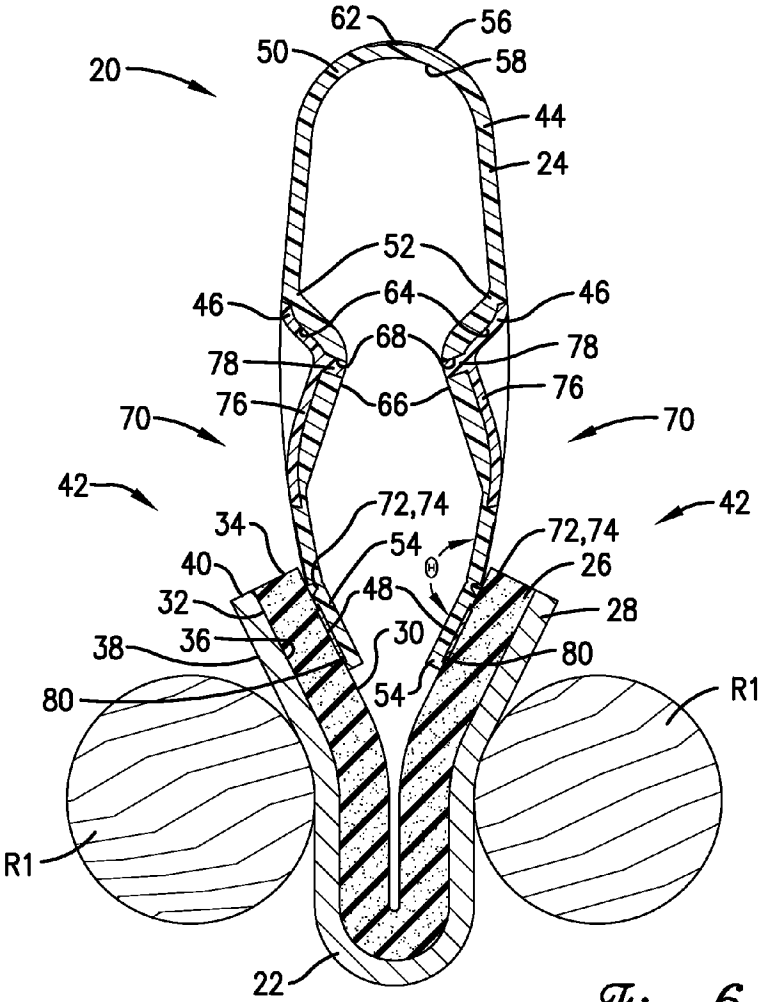
FIG. 6 is a cross section of the material applicator in the convex applicator condition as shown in FIG. 5, showing the flexed pad located between a pair of closely spaced wooden rods to apply material to rod surfaces.
Figure 8:
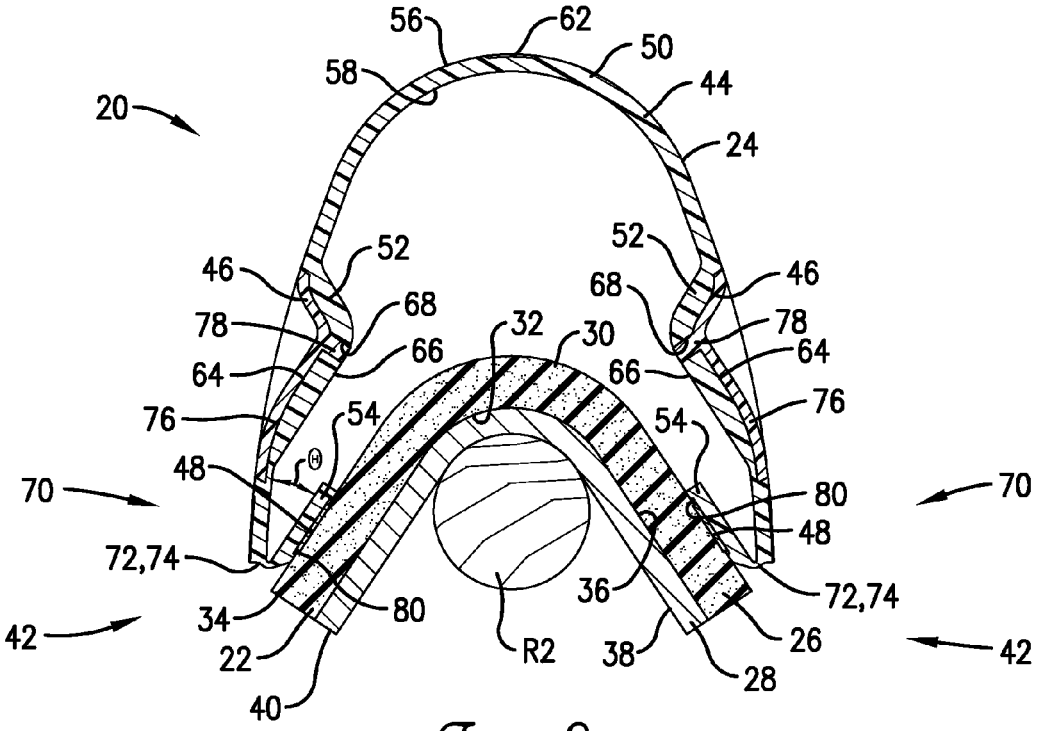
FIG. 8 is a cross section of the material applicator in the concave applicator condition as shown in FIG. 7, showing the flexed pad partly surrounding a wooden rod to apply material to the rod surface.

Turning initially to FIG. 1, a material applicator 20 is configured to provide versatile application of stain or paint onto various three-dimensional surfaces, such as the surfaces of rods R1,R2 (see FIGS. 6 and 8). More particularly, the illustrated applicator 20 is operable to conform to surfaces that are convex, concave, or flat. Furthermore, the applicator 20 can conform to textured surface features such as ridges or grooves. While the applicator 20 is operable to apply stain or paint onto a surface, it is within the scope of the principles of the present invention where the applicator 20 is used to dispense and/or spread other types of materials along a surface. The illustrated applicator 20 broadly includes a material application pad assembly 22 and a frame 24.

Figure 2:
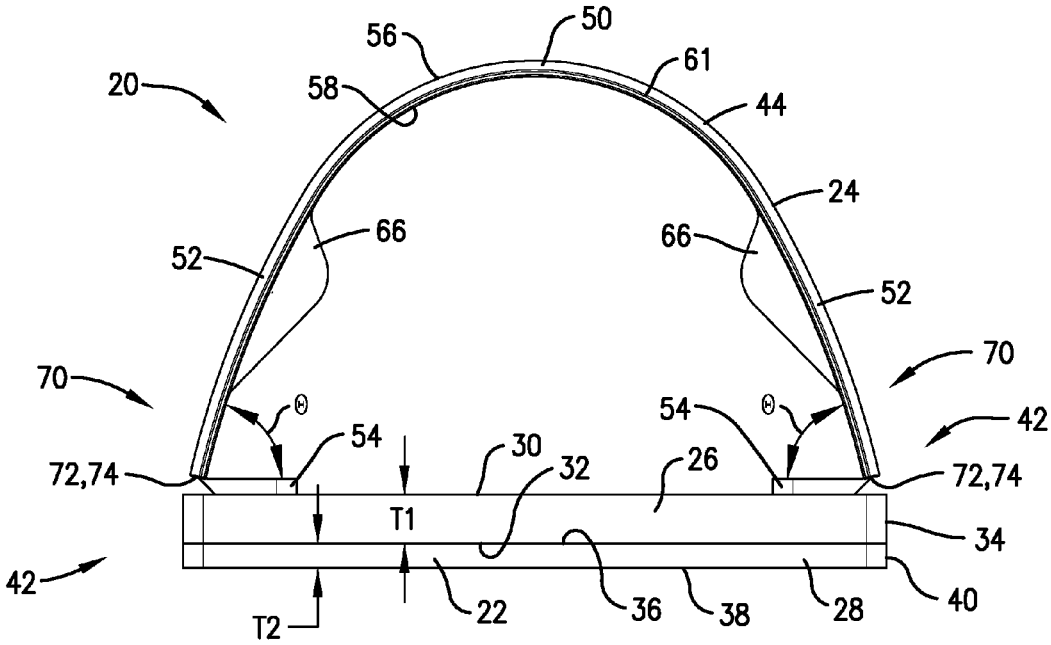
FIG. 2 is a front elevation of the material applicator shown in FIG. 1, showing a frame and material application pad in a relaxed applicator condition, with the pad presenting an outwardly facing material application surface in a substantially flat condition.
Figure 3:
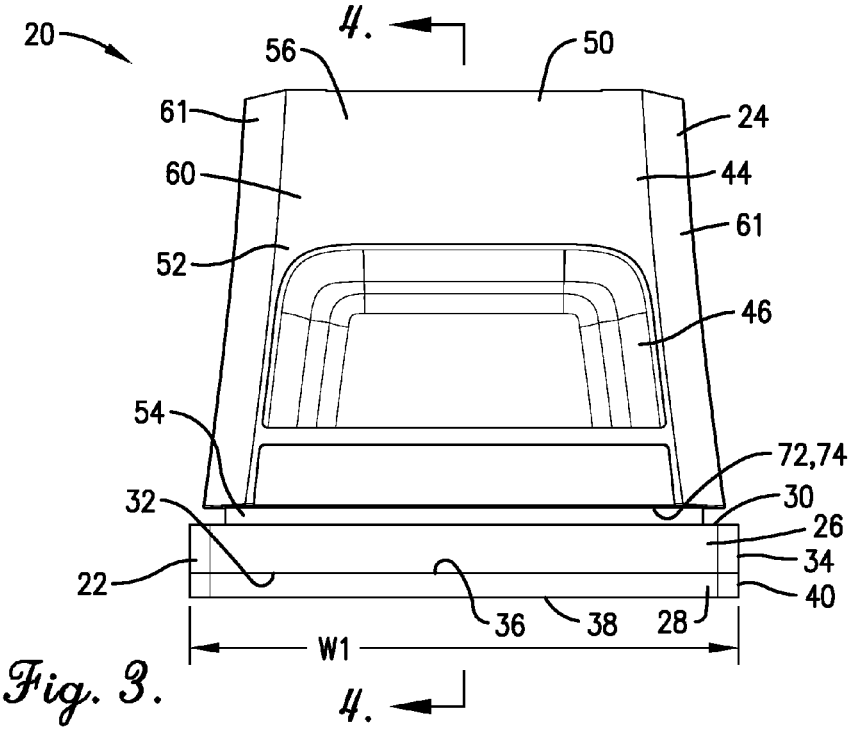
FIG. 3 is a side elevation of the material applicator shown in FIGS. 1 and 2, showing one of two grips attached to the frame.
Figure 4:
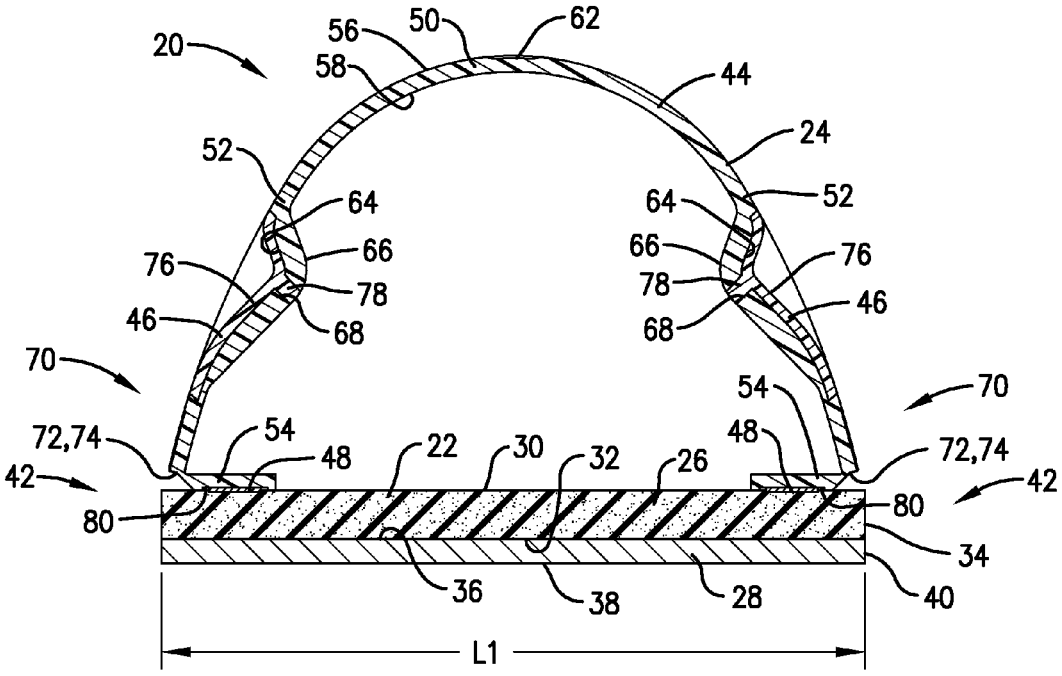
FIG. 4 is a cross section of the material applicator taken along line 4-4 in FIG. 3.

Turning to FIGS. 2-4, the pad assembly 22 is flexible and is operable to apply stain or paint to a surface. The illustrated pad assembly 22 preferably includes a laminated foam layer 26 and a flock layer 28 adhered to one another. The laminated foam layer 26 preferably includes a strip of foam and a strip of felt-type fabric laminated to one another. The laminated foam layer 26 preferably presents upper and lower faces 30,32, with the upper face 30 being presented by the fabric and the lower face 32 being presented by the foam. The laminated foam layer also presents an endless edge 34 that gives the faces 30,32 a rectangular shape. It is also within the ambit of the present invention where the foam layer 26 is shaped so that the faces 30,32 have an alternative geometrical shape, e.g., a circular, square, oval, or triangular shape. The faces 30,32 cooperatively define a substantially constant thickness T1 of the foam layer 26 (see FIG. 2). The thickness T1 preferably ranges from about 1 mm to about 40 mm and, more preferably, is about 10 mm. The strip of foam preferably comprises a sea sponge foam, but could include other natural or synthetic materials to provide a suitably strong and flexible backing for flock layer 28 without departing from the scope of the present invention. As will be discussed, the fabric strip serves as loop material of a hook-and-loop connector arrangement that interconnects the pad assembly 22 and frame 24.

The flock layer 28 preferably presents upper and lower faces 36,38, with an endless edge 40 that gives the faces 36,38 a rectangular shape. Similar to foam layer 26, the faces 36,38 could have an alternative geometrical shape, e.g., a circular, square, oval, or triangular shape, although faces 36,38 preferably have substantially the same size and shape as faces 30,32. Preferably, the rectangular layers 26,28 present a pad length L1 that ranges from about 50 mm to about 200 mm and, more preferably, is about 110 mm. The layers 26,28 also preferably present a pad width W1 that ranges from about from about 20 mm to about 200 mm and, more preferably is about 89 mm.

The faces 36,38 cooperatively define a substantially constant thickness T2 of the flock layer 28 (see FIG. 2). The thickness T2 preferably ranges from about 1 mm to about 10 mm and, more preferably, is about 4.5 mm. The flock layer 28 is preferably flexible so as to flex with the foam layer 26.

The illustrated layers 26,28 preferably are secured to one another by adhering lower face 32 to upper face 36 at locations between the faces 32,36 using a suitable adhesive (not shown). Thus, the lower face 38 of flock layer 28 faces outwardly and serves as the material application surface of the pad. The layers 26,28 cooperatively present opposite ends 42 of the pad assembly 22.

While the illustrated pad assembly 22 preferably includes only layers 26,28, it is also within the ambit of the present invention to include additional layers or to use only a single layer, e.g., to improve the stain or paint application performance of the applicator 20.

Furthermore, the pad assembly 22 could include other components, e.g., to provide convenient use of the applicator 20. For instance, as shown in the incorporated '804 Application, the pad assembly 22 could include a latching component, such as a clip, for securing the pad assembly 22 to the frame 24.

As mentioned above, the layers 26,28 cooperate so that the pad assembly 22 is flexible. Preferably, the pad assembly 22 is operable to flex into and out of a relaxed applicator condition, where the layers 26,28 are preferably substantially flat, i.e., where faces 30,32,36,38 lie in corresponding planes (see FIGS. 1-4). However, it is also within the ambit of the present invention where the layers 26,28 present a shape so that at least one of the faces 30,32,36,38 presents a non-planar surface in the relaxed applicator condition, e.g., where face 38 includes generally concave and/or convex portions. When attached to the frame 24, the pad assembly 22 is pulled taut by the frame 24 (i.e., the pad assembly 22 is generally under tension) and generally assumes the relaxed applicator condition.

Figure 5:
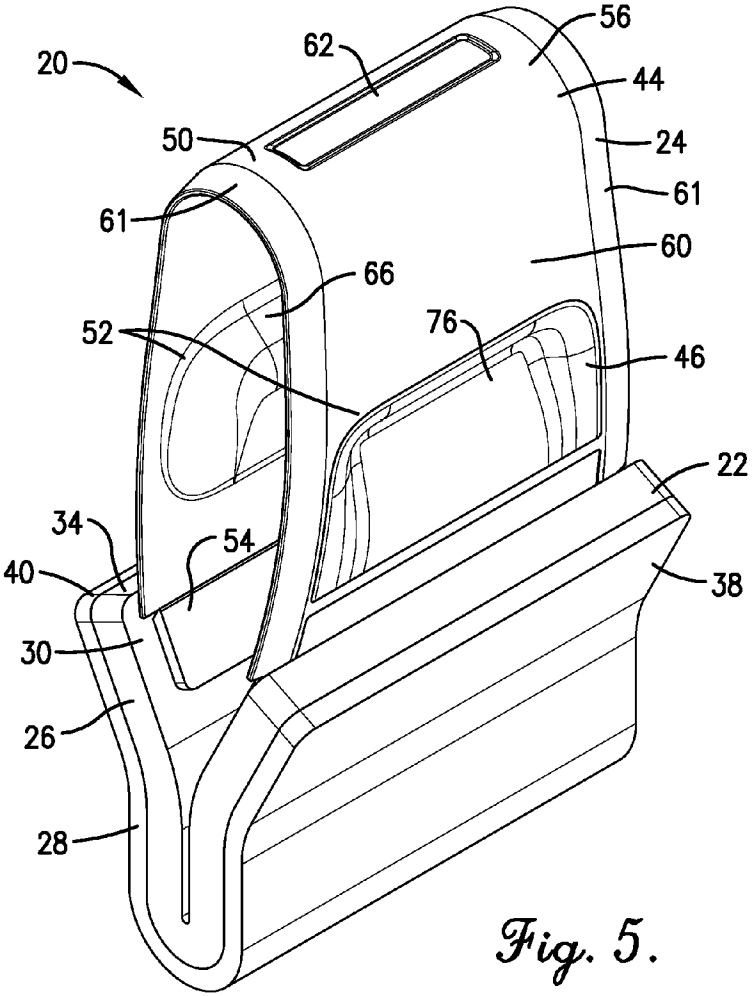
FIG. 5 is a perspective of the material applicator shown in FIGS. 1-4, showing the applicator in a convex applicator condition where the pad is flexed so that the central portion of the outwardly facing material application surface is convex.
Figure 7:
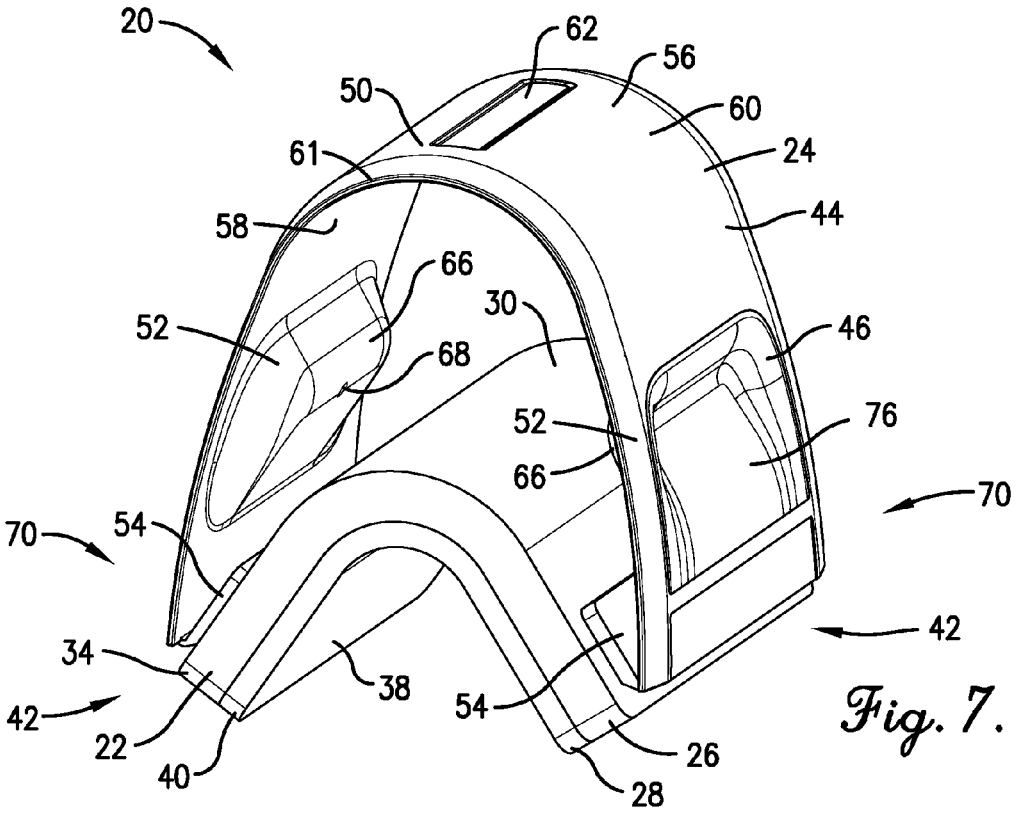
FIG. 7 is a perspective of the material applicator shown in FIGS. 1-4, showing the applicator in a concave applicator condition where the pad is flexed so that the central portion of the outwardly facing material application surface is concave.

The illustrated pad assembly 22 is also operable to flex between the relaxed applicator condition and a convex applicator condition where the face 38 of flock layer 28 includes a central portion that assumes a convex shape (see FIGS. 5 and 6). Furthermore, the pad assembly 22 is operable to flex between the relaxed applicator condition and a concave applicator condition where the central portion of face 38 assumes a concave shape (see FIGS. 7 and 8).

Turning to FIGS. 1 and 9-11, the frame 24 serves as a handle for the applicator 20 and presents locations to grip the applicator 20. Furthermore, the frame 24 is constructed to flex the pad assembly 22 and permit manual holding of the pad assembly 22 in a flexed applicator condition, i.e., where the applicator is not in the relaxed condition. The illustrated frame 24 preferably includes a body 44, overmolded grips 46, and pad securement strips 48.

The body 44 is flexible and broadly includes a central portion 50 and opposite grip portions 52 that project in opposite longitudinal directions from the central portion 50. The body 44 also includes tabs 54, with the portions 50,52 and tabs 54 cooperatively presenting upper and lower faces 56,58 of the body 44. The illustrated portions 50,52 also cooperatively present a longitudinally-extending intermediate section 60 and opposite tapering side margins 61. The section 60 generally presents a substantially constant thickness T3, although the thickness T3 of grip portions 52 varies slightly along pockets thereof. The thickness T3 preferably ranges from about 0.5 mm to about 5 mm. More preferably, along the central portion 50 the thickness T3 is about 2.5 mm. However, for some aspects of the present invention, the portions 50,52 could have alternative thicknesses. For example, the central portion 50 could be thinner than grip portions 52 along section 60, to provide suitable operation of the applicator 20. Also, the illustrated central portion 50 includes a centrally located recessed region 62 operable to depict indicia (not shown) associated with the applicator 20.

The grip portions 52 are each shaped to define shallow pockets 64 along the upper face 56, with corresponding projections 66 along the lower face 58. The grip portions 52 also present holes 68 that extend through the grip portions 52. The grip portions 52 further present ends 70 that preferably provide opposite handle margins. As will be discussed, the pockets 64 receive overmolded grips 46.

Again, the central and grip portions 50,52 cooperatively present tapering side margins that extend between the ends 70. The side margins preferably present a concave shape so as to define a body width W2 that gradually decreases from a maximum width dimension adjacent the ends 70 to a minimum width dimension at a midpoint along the central portion 50 (see FIG. 10). Preferably, the maximum width dimension of the body width W2 is about 82 mm and the minimum width dimension is about 69 mm. However, it is also within the scope of the present invention where the body 44 presents an alternative shape. For instance, the body 44 may present a body width W2 having a constant width dimension along portions 50,52.

Turning to FIGS. 5-8, the portions 50,52 are constructed so that relative pivotal movement is permitted between the grip portions 52 as the body 44 moves between the detached condition, the relaxed applicator condition, and flexed applicator condition. More particularly, the portions 50,52 are configured so that central portion 50 generally flexes to a greater degree than portions 52 as the body 44 is shifted between the various conditions. In flexed conditions, the central portion 50 also preferably urges the applicator 20 to return to the relaxed condition. As will be discussed in greater detail, the grip portions 52 are configured to shift the pad assembly 22 into and out of a desired applicator condition and to also hold the pad assembly 22 in that condition. Specifically, the grip portions 52 are operable to be grasped and held by the thumb and fingers of an operator's hand. The grip portions 52 are shiftable toward and away from each other due to the flexible construction of the frame 24, particularly the central portion 50 of body 44. As the grip portions 52 are moved relative to each other (i.e., toward or away from each other), the tabs 54 also move relative to each other in a corresponding manner. As will be explained, such movement of the tabs 54 causes corresponding movement between ends 42 of the pad assembly 22.

Turning again to FIGS. 9-11, the tabs 54 are unitary and are preferably integrally formed with portions 50,52 of body 44. The illustrated grip portions 52 and tabs 54 cooperatively define lateral grooves 72 so that the grip portions 52 and tabs 54 are connected by living hinges 74. However, the principles of the present invention are applicable where the tabs 54 are alternatively configured. For instance, the grip portions 52 and tabs 54 could be shiftably interconnected by an alternative hinge arrangement. Furthermore, it is within the scope of the present invention where the grip portions 52 and tabs 54 are not integrally formed.

The portions 50,52 and tabs 54 are preferably integrally molded by injection molding. However, it is also within the scope of the present invention where the body 44 is made using other manufacturing techniques, e.g., other molding methods. The body 44 is also preferably formed of a synthetic resin material. More preferably, the portions 50,52 and tabs 54 comprise a polypropylene material.

Turning to FIGS. 1-8, the illustrated hinges 74 permit swingable flexing movement of the tabs 54 relative to the portions 50,52 between the relaxed condition (see FIGS. 1-4) and flexed conditions (see FIGS. 5-8). In a detached condition, where the frame 24 is detached from the pad assembly 22, the grip portion 52 and tab 54 cooperatively define an included angle θ that is preferably about 180 degrees (see FIG. 11). In the relaxed applicator condition, the included angle θ preferably ranges from about 60 degrees to about 90 degrees and, more preferably, is about 75 degrees (see FIGS. 1-4). In the convex applicator condition, the included angle θ preferably ranges from about 135 degrees to about 180 degrees and, more preferably, is about 165 degrees (see FIGS. 5 and 6). In the concave applicator condition, the included angle θ preferably ranges from about 0 degrees to about 90 degrees and, more preferably is about 30 degrees (see FIGS. 7 and 8).

Preferably, the grooves 72 are positioned along the upper face 56 so that the tabs 54 are operable to pivot from the detached condition toward the lower face 58 of the central portion 50 (i.e., by folding under the portions 52). However, it is also within the ambit of the present invention where the tabs 54 pivot from the detached condition toward the upper face 56 (i.e., by folding above the portions 52).

Figure 11:
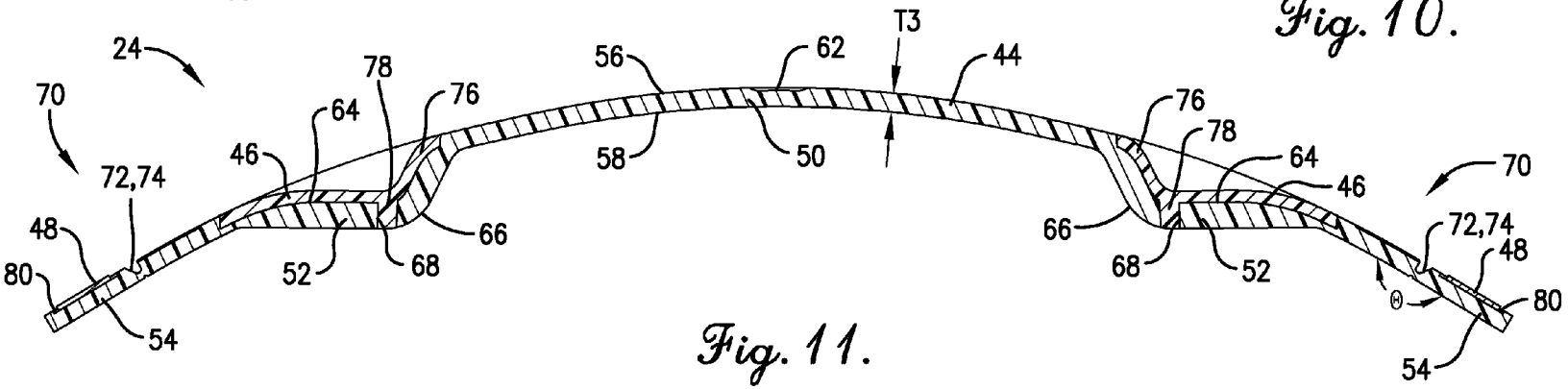
FIG. 11 is a cross section of the frame taken along line 11-11 in FIG. 10.

Turning to FIGS. 4 and 11, the overmolded grips 46 are preferably unitary and include a material layer 76 that substantially conforms to the shape of pocket 64. The grip 46 also includes a stud 78 that projects from the layer 76 and is received by hole 68 to secure the grip 46 onto the grip portion 52. Preferably, the grips 46 are molded by injection molding. However, it is also within the scope of the present invention where the grips 46 are made using other manufacturing techniques, e.g., other molding methods. Furthermore, while the grips are preferably overmolded onto the grip portions 52, the grips 46 could be otherwise molded separately from the body 44 or comolded with the body 44. The grips 46 preferably comprise a synthetic resin material and, more preferably, comprise a thermoplastic resin. Most preferably, the grips 46 comprise a thermoplastic elastomer (TPE) material.

Figure 9:
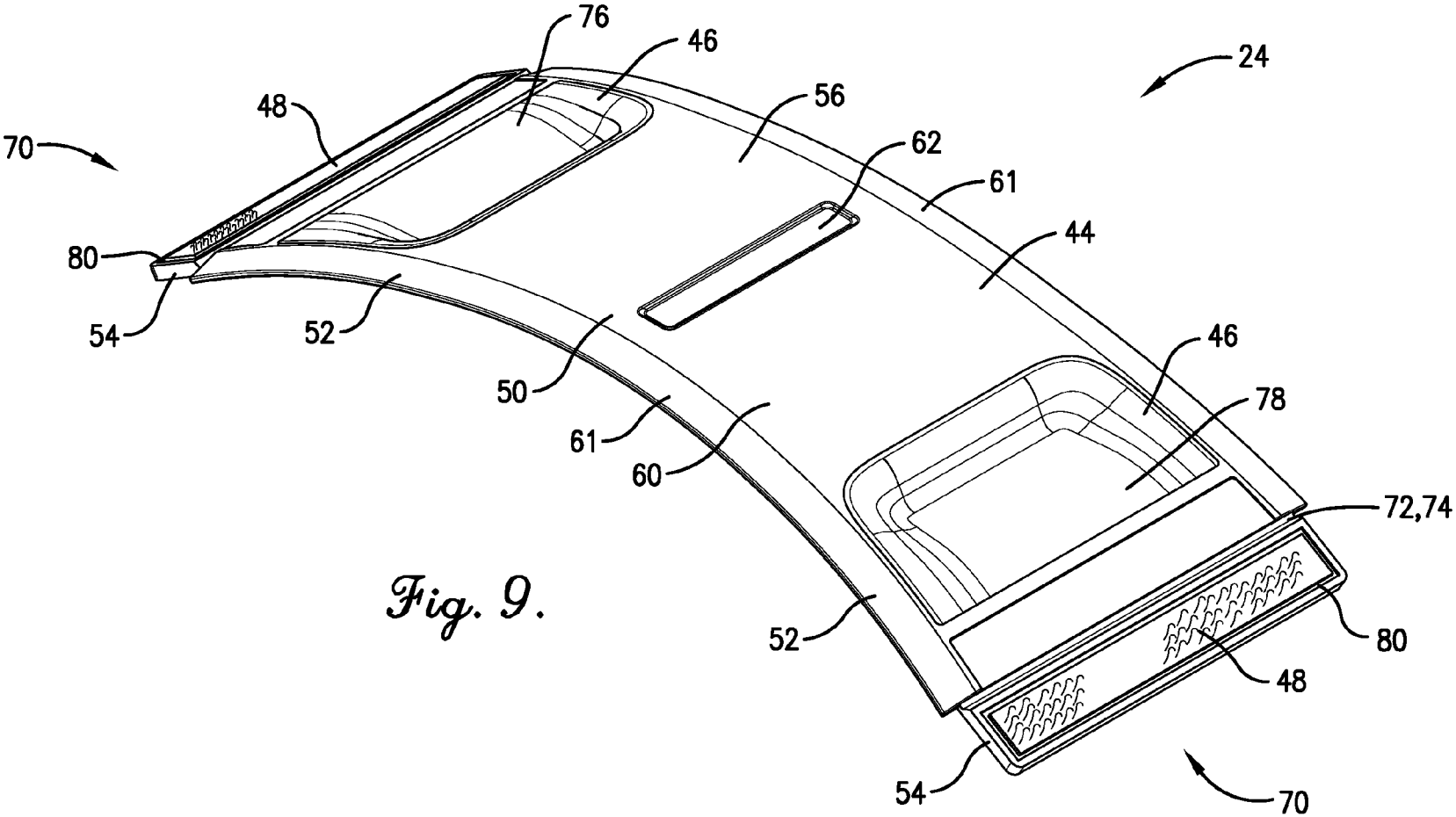
FIG. 9 is a perspective of the frame shown in FIGS. 1-8, showing the frame detached from the pad in a detached condition.
Figure 10:
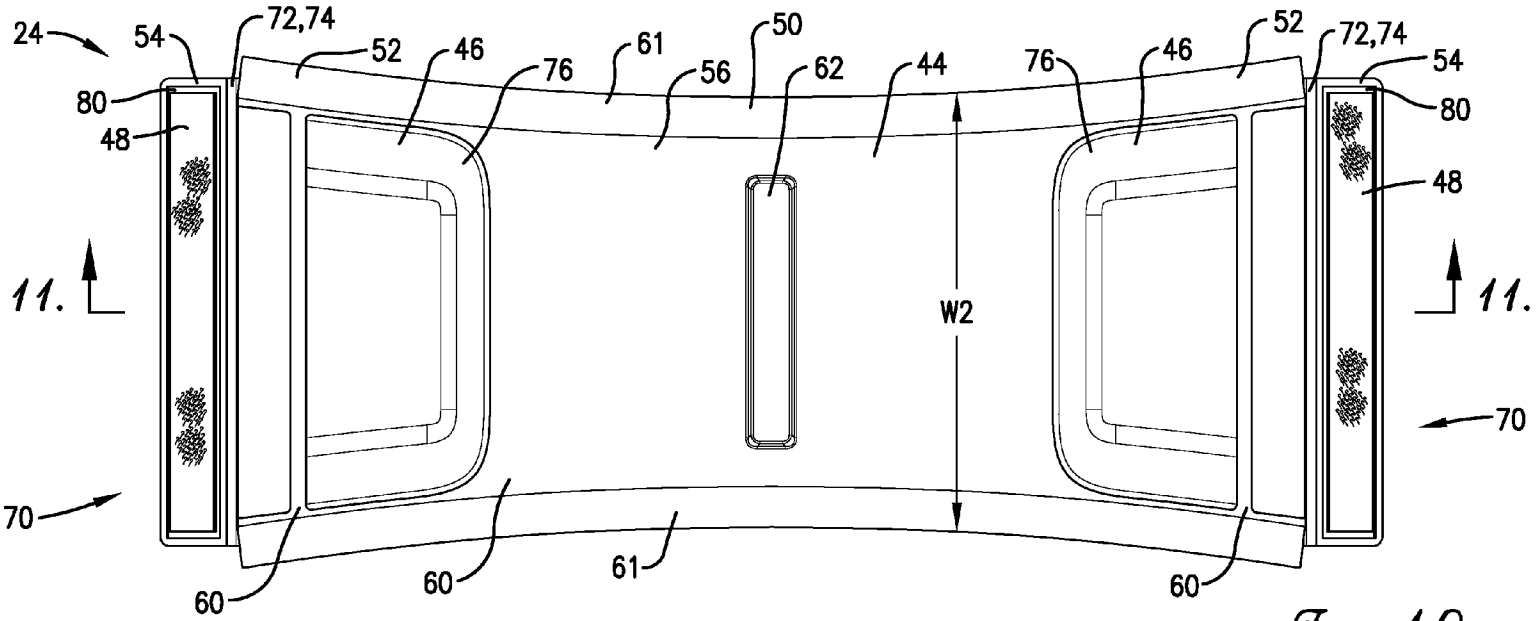
FIG. 10 is a top view of the frame shown in FIG. 9.

Turning to FIGS. 9-11, the securement strips 48 preferably include a hook-fastening fabric with hook elements (i.e., associated with hook-and-loop fasteners) and an adhesive backing layer. The strips 48 are cut preferably into rectangular strips sized to fit onto the upper face 56 of tabs 54. The fabric presents a hooked front face and a smooth back face. The adhesive layer (not shown) is applied to the back face of the fabric to adhere the fabric to the tab 54.

For some aspects of the present invention, the hook elements of strips 48 could be alternatively provided. For instance, in another preferred embodiment of the present invention, the hook elements of the hook-and-loop construction are integrally molded as part of the tabs 54. Preferred features of such molded hook elements and the associated methods are disclosed in U.S. Pat. No. 7,438,845, issued Oct. 21, 2008, entitled METHOD FOR MANUFACTURING ARTICLE WITH INTEGRALLY FORMED HOOKS WITH SHEAR AT HOOK-BEARING SURFACE; U.S. Reissue Pat. No. RE 37,338, issued Aug. 21, 2001, entitled METHOD FOR INJECTION-MOLDING AN ORTHOPEDIC DEVICE AND PRODUCT OF THE METHOD; and U.S. Pat. No. 5,656,226, issued Aug. 12, 1997, entitled METHOD AND APPARATUS FOR INJECTION-MOLDING A THERMOPLASTIC DEVICE, all of which are enclosed in the attached Appendix and are hereby incorporated in their entirety by reference herein.

Preferably, the strips 48 are adhered to upper face 56 of the tabs 54. In particular, the upper face 56 includes a rectangular recessed area 80 sized to receive the corresponding strip 48 (see FIG. 9). However, the principles of the present invention are applicable where the strips 48 are adhered to the lower face 58, e.g., so that tabs 54 project laterally outwardly from the grip portions 52 when attached to pad assembly 22.

Turning to FIGS. 2-8, the illustrated strips 48 are removably attached to the upper face 30 presented by the felt-type fabric of the pad assembly 22 adjacent to corresponding ends 42. Preferably, the hooks of the hooked front face are directly removably attached to the upper face 30 by engaging the loop elements of the fabric. However, it is also within the scope of the present invention where the strips 48 are attached to alternative loop elements. Again, it is within the ambit of the present invention where hook elements are alternatively provided on tabs 54 to provide hook-and-loop interconnection between the tabs 54 and the pad assembly 22.

Furthermore, the tabs 54 could be attached to an alternative location on pad assembly 22. For instance, the tabs 54 could be attached to edge 34 along corresponding ends 42. Also, the tabs 54 could be attached to face 32 between the layers 26,28.

When attached to the pad assembly 22, the illustrated tabs 54 preferably project laterally inwardly from the hinges 74 (i.e., the tabs 54 fold under the grip portions 52). The principles of the present invention are also applicable where the strips 48 and tabs 54 are alternatively arranged for attachment to pad assembly 22. For example, the tabs 54 and hinges 74 could be configured so that the tabs 54 project laterally outwardly from the hinges 74 when attached to the pad assembly 22, with the ends 70 being spaced laterally inwardly from ends 42 of pad assembly 22. In that instance, the strips 48 could be adhered to the lower face 58, as mentioned above.

The applicator 20 preferably utilizes strips 48 to provide removable attachment between the pad assembly 22 and tabs 54. However, it is also within the ambit of the present invention where other types of fasteners (e.g., threaded fasteners or removable or repositionable adhesive) are used to secure the tabs 54 to the pad assembly 22.

While the illustrated pad assembly 22 and frame 24 are preferably removably attached to one another, the principles of the present invention are applicable where the pad assembly 22 and frame 24 are substantially permanently attached. For instance, the tabs 54 could be permanently adhered directly to the pad assembly 22.

For some aspects of the present invention, the pad assembly 22 and frame 24 could be alternatively attached to one another to provide adjustable flexing of the pad assembly 22. As shown in the incorporated '804 Application, an alternative embodiment of the applicator includes an alternative pad and alternative frame. The frame is flexible and includes elongated slots positioned adjacent to opposite ends of the frame. The pad includes elongated registration clips secured relative to the foam layer of pad adjacent to opposite ends of the pad. The lugs are removably inserted into corresponding slots of the frame.

As mentioned above, the frame 24 provides a handle for grasping and controlling the applicator 20. The frame 24 is operable to be shifted so as to flex the pad assembly 22 and hold the pad assembly 22 in a desired applicator condition. Preferably, the pad assembly 22 and frame 24 are attached so that the central portion 50 is spaced from the pad assembly 22 and is flexible to permit shifting of ends 70 relative to one another. As the grip portions 52 are shifted relative to each other, the tabs 54 move relative to each other in a corresponding manner. When the tabs 54 are removably attached adjacent to ends 42 of the pad assembly 22, movement of the tabs 54 causes corresponding relative movement between ends 42.

Movement of the grip portions 52 from the relaxed applicator condition toward one another can cause the pad assembly 22 to shift either toward the convex or concave applicator conditions. For example, when the grip portions 52 are squeezed toward each other and pressure is applied to the upper face 30 of foam layer 26 (e.g., when the operator applies pressure to the foam layer 26 using a structural element, such as a rod or the operator's finger), the central portion of pad assembly 22 flexes outwardly and away from the frame 24 toward the convex applicator condition (see FIGS. 5 and 6). Similarly, when the grip portions 52 are squeezed toward each other and pressure is applied to the lower face 38 of flock layer 28 (e.g., when the operator applies pressure to the flock layer 28 using a structural element, such as the rod R2 or the operator's finger), the central portion of pad assembly 22 flexes inwardly toward the frame 24 and toward the concave applicator condition (see FIGS. 7 and 8). When gripping pressure is removed from the grip portions 52, the central portion 50 urges the grip portions 52 away from each other so that the frame 24 pulls the pad assembly 22 taut in the relaxed applicator condition.

In operation, the applicator 20 is used to apply stain, paint, or other materials to a surface. Material is first placed on the pad assembly 22. In the usual manner, this is done by grasping the frame 24 and dipping the pad assembly 22 into an open container of material so that the pad assembly 22, particularly the flock layer 28, becomes at least partly saturated with the material. Preferably, the pad assembly 22 is in the relaxed applicator condition as the pad assembly 22 is dipped into the material so that the pad assembly 22 is evenly saturated with material along the outer face. However, the pad assembly 22 could also be flexed while the pad is being saturated with material.

The saturated pad assembly 22 is then moved into engagement with a surface so that the material can be applied to the surface. For example, stain can be applied to a surface by sliding the stain-saturated pad along the surface and applying light pressure to the handle to compress the pad against the surface. Material application can be performed with the pad assembly 22 in one of multiple applicator conditions. For example, material can be applied to a flat or undulating surface (not shown) while the pad assembly 22 is in the relaxed applicator condition. Alternatively, material can be applied to a surface by shifting the pad assembly 22 into a flexed condition. For instance, the pad assembly 22 can be shifted into the convex applicator position to apply material to one or both of a pair of closely-spaced elements, such as rods R1 (see FIG. 6). Furthermore, the pad assembly 22 can be shifted into the concave applicator position to apply material to an element presenting a convexly-shaped surface, such as rod R2 (see FIG. 8).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A liquid applicator comprising:

a frame including an elongated handle that presents opposite handle margins and extends in a longitudinal direction between the margins, said frame further including a pair of endmost connectors integrally formed with the handle, each of said connectors being hingedly coupled to respective ones of the handle margins; and a flexible applicator pad that presents opposite applicator pad ends, said flexible applicator pad presenting an application face and an opposite connection face, with the faces extending between the applicator pad ends, said connectors each presenting a connector face, said connectors being coupled to the flexible applicator pad adjacent corresponding applicator pad ends, with the connector faces being in face-to-face engagement with the connection face of the applicator pad, each of said connectors extending from a respective one of the handle margins toward the other connector to present a connector end, with the flexible applicator pad presenting a central section thereof that is detached from the frame, said handle presenting a region intermediate the handle margins that is flexible and spaced from the applicator pad to permit relative shifting of the handle margins, with the frame and flexible applicator pad thereby being shiftable into and out of a relaxed applicator condition as the handle margins are moved away from and toward each other.

2. The liquid applicator as claimed in claim 1, said connectors each being joined to the handle by a laterally extending living hinge, said connectors each including a laterally extending strip that presents the corresponding connector face, with the connector faces being removably attached to the connection face of the applicator pad, said connectors each projecting inboard from the respective living hinge so that both connector faces face generally oppositely from the handle when in the relaxed applicator condition.

3. The liquid applicator as claimed in claim 1, said intermediate region being curved along the longitudinal direction when the frame is attached to the applicator pad, said handle including gripping regions adjacent the respective handle margins, with the gripping regions being interconnected by the intermediate region.

4. The liquid applicator as claimed in claim 3, said flexible handle presenting a thickness dimension measured in a direction transverse to the longitudinal direction, said thickness dimension decreasing progressively from the gripping regions toward the intermediate region so that the handle is more flexible along the intermediate region than the gripping regions.

5. The liquid applicator as claimed in claim 3, said gripping regions being shiftable relative to one another from a first position associated with the relaxed applicator condition to a second position associated with at least one flexed applicator condition, with shifting of the gripping regions from the first position to the second position causing a central region of the applicator pad to flex.

6. The liquid applicator as claimed in claim 5, said gripping regions moving toward one another when shifting from the first position to the second position.

7. The liquid applicator as claimed in claim 5, said application face facing generally oppositely from the handle, said application face being substantially planar in the relaxed applicator condition, said at least one flexed applicator condition including a concave applicator condition and a convex applicator condition, said concave applicator condition associated with flexing of the applicator pad so that the application face is generally concave along the central region, said convex applicator condition associated with flexing of the applicator pad so that the application face is generally convex along the central region.

8. The liquid applicator as claimed in claim 1, said applicator pad presenting an application face that faces generally outwardly from the handle, said applicator pad including a foam layer and a flock layer adhered to one another, said connectors being attached to the foam layer, so that the flock layer provides the application face.

9. The liquid applicator as claimed in claim 1, said intermediate region being curved along the longitudinal direction, said intermediate region being flexed in the relaxed applicator condition so that the handle margins urge the applicator pad ends in opposite directions to hold the applicator pad under tension.

10. The liquid applicator as claimed in claim 9, said handle including gripping regions adjacent the respective handle margins, with the gripping regions being interconnected by the intermediate region, said gripping regions being shiftable relative to one another from a first position associated with the relaxed applicator condition to a second position associated with at least one flexed applicator condition, with shifting of the gripping regions from the first position to the second position causing a central region of the applicator pad to flex, said gripping regions moving toward one another when shifting from the first position to the second position, such that the intermediate region is in a relatively greater flexed condition when the gripping regions are in the second position than when the gripping regions are in the first position.

* * * * *